US012011059B2

(12) United States Patent
Durflinger et al.

(10) Patent No.: US 12,011,059 B2
(45) Date of Patent: Jun. 18, 2024

(54) SOLE STRUCTURE FOR ARTICLE OF FOOTWEAR

(71) Applicant: NIKE, Inc., Beaverton, OR (US)

(72) Inventors: Nate Durflinger, Beaverton, OR (US); Lai Wa C. Ho, Beaverton, OR (US); Emily Simmons, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 357 days.

(21) Appl. No.: 17/326,962

(22) Filed: May 21, 2021

(65) Prior Publication Data

US 2021/0361027 A1 Nov. 25, 2021

Related U.S. Application Data

(60) Provisional application No. 63/029,118, filed on May 22, 2020.

(51) Int. Cl.

| | |
|---|---|
| ***A43B 13/12*** | (2006.01) |
| ***A43B 13/18*** | (2006.01) |
| ***A43B 13/20*** | (2006.01) |
| ***A43B 13/37*** | (2006.01) |
| ***A43B 21/32*** | (2006.01) |

(52) U.S. Cl.

CPC ..... *A43B 13/127* (2013.01); *A43B 13/186* (2013.01); *A43B 13/20* (2013.01); *A43B 13/37* (2013.01); *A43B 21/32* (2013.01)

(58) Field of Classification Search

None

See application file for complete search history.

(56) References Cited

U.S. PATENT DOCUMENTS

| | | | | | |
|---|---|---|---|---|---|
| 2,261,453 | A * | 11/1941 | Reinhart | A43B 23/14 | 36/89 |
| 4,972,613 | A * | 11/1990 | Loveder | A43B 5/00 | 36/105 |
| 5,408,761 | A * | 4/1995 | Gazzano | A43C 11/008 | 36/31 |
| 5,819,440 | A * | 10/1998 | Okajima | A43B 23/17 | 36/88 |
| 5,901,469 | A * | 5/1999 | Saillet | A43B 5/0482 | 36/119.1 |
| 6,018,892 | A * | 2/2000 | Acheson | A43B 7/20 | 36/117.6 |
| 7,757,412 | B2 * | 7/2010 | Farys | A43C 1/04 | 36/58.6 |

(Continued)

FOREIGN PATENT DOCUMENTS

| | | | |
|---|---|---|---|
| WO | WO-9320725 | A1 | 10/1993 |
| WO | WO-2020018473 | A1 | 1/2020 |

OTHER PUBLICATIONS

European Patent Office, PCT International Search Report/Written Opinion for Application PCT/US2021/033794 dated Aug. 11, 2021.

*Primary Examiner* — Jila M Mohandesi

(74) *Attorney, Agent, or Firm* — Honigman LLP; Matthew H. Szalach; Jonathan P. O'Brien

(57) ABSTRACT

An article of footwear includes an upper extending from a first end in a forefoot region to a second end in a heel region. The article of footwear also includes a sole structure attached to the upper and including a posterior end extending beyond the second end of the upper. The sole structure includes a bladder having a portion disposed between the second end of the upper and the posterior end of the sole structure.

14 Claims, 11 Drawing Sheets

(56) References Cited

U.S. PATENT DOCUMENTS

| | | | | |
|---|---|---|---|---|
| 7,814,685 | B1 * | 10/2010 | Tankson | A43B 5/007 36/72 B |
| 9,848,674 | B2 * | 12/2017 | Smith | A43C 11/00 |
| 9,867,426 | B2 * | 1/2018 | Conant | A43B 13/188 |
| 2005/0138846 | A1 * | 6/2005 | O'Connor | A43B 23/30 36/72 B |
| 2005/0262739 | A1 * | 12/2005 | McDonald | A43B 13/16 36/102 |
| 2011/0179669 | A1 * | 7/2011 | Hanebrink | A43B 21/265 36/28 |
| 2016/0120262 | A1 * | 5/2016 | Cortez | A43B 13/127 12/146 B |
| 2022/0287408 | A1 * | 9/2022 | Eldem | A43B 13/20 |

* cited by examiner

SOLE STRUCTURE FOR ARTICLE OF FOOTWEAR

CROSS REFERENCE TO RELATED APPLICATIONS

This application claims priority under 35 U.S.C. § 119(e) to U.S. Provisional Application No. 63/029,118, filed on May 22, 2020. The disclosure of this prior application is considered part of the disclosure of this application and is hereby incorporated by reference in its entirety.

FIELD

The present disclosure relates generally to articles of footwear, and more particularly, to sole structures for articles of footwear.

BACKGROUND

This section provides background information related to the present disclosure, which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces. The midsole may additionally or alternatively incorporate a fluid-filled bladder to provide cushioning to the foot by compressing resiliently under an applied load to attenuate ground-reaction forces. Sole structures may also include a comfort-enhancing insole or a sockliner located within a void proximate to the bottom portion of the upper and a strobel attached to the upper and disposed between the midsole and the insole or sockliner.

Midsoles employing bladders typically include a bladder formed from two barrier layers of polymer material that are sealed or bonded together. The bladders may contain air, and are designed with an emphasis on balancing support for the foot and cushioning characteristics that relate to responsiveness as the bladder resiliently compresses under an applied load.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
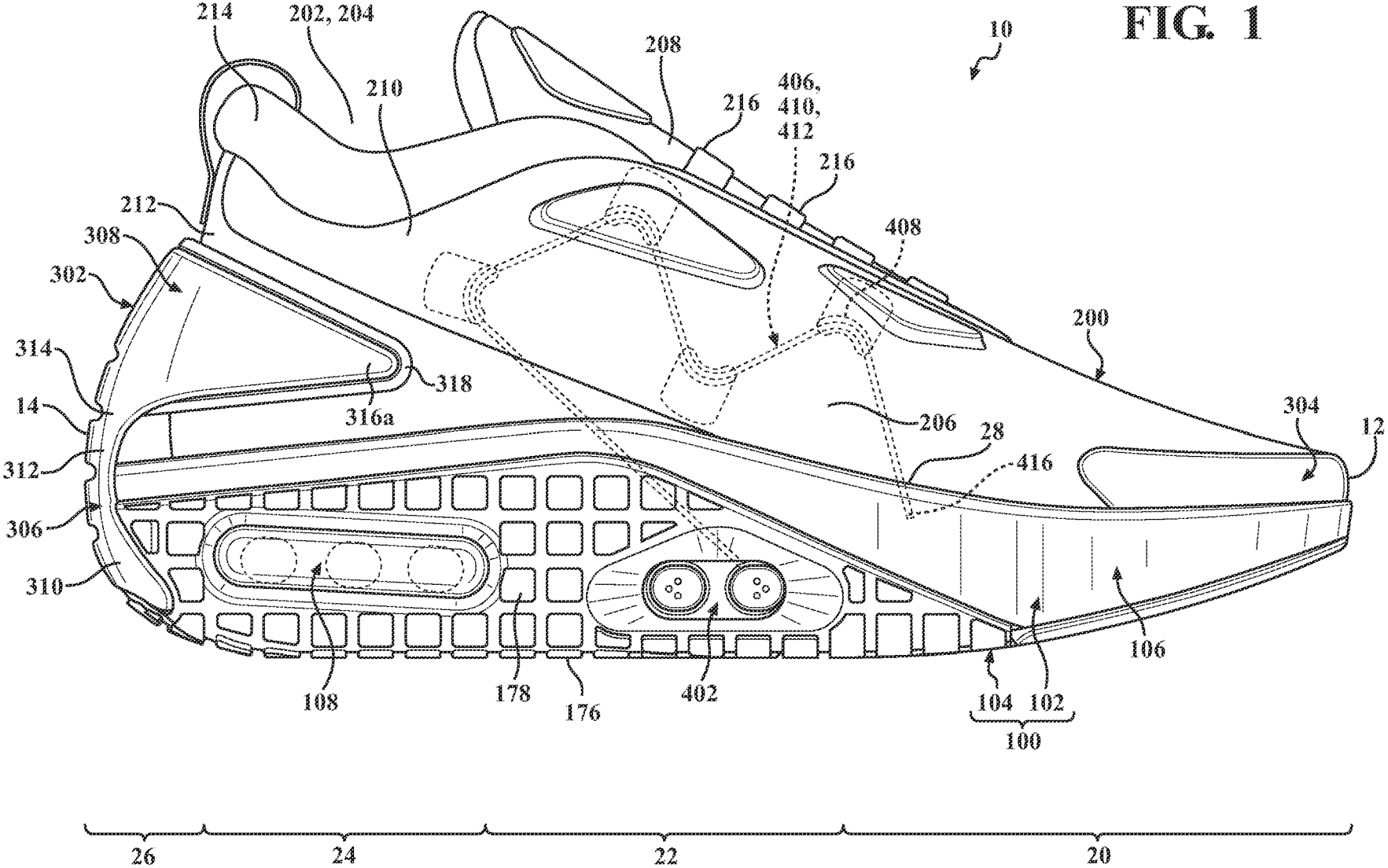
FIG. 1 is a lateral side view of an article of footwear including a sole structure in accordance with the principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

One aspect of the disclosure provides an article of footwear. The article of footwear includes an upper extending from a first end in a forefoot region to a second end in a heel region. The article of footwear also includes a sole structure attached to the upper and including a posterior end extending beyond the second end of the upper. The sole structure includes a bladder having a portion disposed between the second end of the upper and the posterior end of the sole structure.

Implementations of the disclosure may include one or more of the following optional features. In some implementations, the article of footwear includes a buttress connecting the posterior end of the sole structure to the second end of the upper. Here, the buttress may include a stanchion attached to the posterior end of the sole structure and to a heel clip attached to the second end of the upper. The stanchion may include a portion that is spaced apart from the second end of the upper. The article of footwear may include a heel counter attached to the second end of the upper, the buttress being attached to the second end of the upper at the heel counter. The buttress may include a heel clip attached to the heel counter, the heel clip being formed of a first material and the heel counter being formed of a second material having a lower hardness than the first material.

In some examples, the sole structure includes a footbed and a bolster extending from the footbed at the posterior end. A portion of the bladder may be located within the bolster of the sole structure. The sole structure may include a cushioning element including a first material and a cradle including a second material, the bladder being received between the cushioning element and the cradle. The sole structure may include a tensioning device disposed therein, the tensioning device receiving a tensioning member and operable to move the tensioning member between an extended state and a retracted state to move the upper between a loosened state and a tightened state.

Another aspect of the disclosure provides an article of footwear. The article of footwear includes an upper extending from a first end in a forefoot region to a second end in a heel region. The article of footwear also includes a sole structure attached to the upper and including a posterior end extending beyond the second end of the upper. The sole structure includes a bladder having a first portion disposed between the first end of the upper and the second end of the upper and a second portion extending beyond the second end of the upper.

This aspect may include one or more of the following optional features. In some configurations, the article of footwear includes a buttress connecting the posterior end of the sole structure to the second end of the upper. The buttress may include a stanchion attached to the posterior end of the sole structure and to a heel clip attached to the second end of the upper. The stanchion may include a portion that is spaced apart from the second end of the upper. The article of footwear may include a heel counter attached to the second end of the upper, the buttress being attached to the second end of the upper at the heel counter. The buttress may include a heel clip attached to the heel counter, the heel clip being formed of a first material and the heel counter being formed of a second material having a lower hardness than the first material.

In some implementations, the sole structure includes a footbed and a bolster extending from the footbed at the posterior end. A portion of the bladder may be located within the bolster of the sole structure. The sole structure may include a cushioning element including a first material and a cradle including a second material, the bladder being received between the cushioning element and the cradle. The sole structure may include a tensioning device disposed therein, the tensioning device receiving a tensioning member and operable to move the tensioning member between an extended state and a retracted state to move the upper between a loosened state and a tightened state.

The details of one or more implementations of the disclosure are set forth in the accompanying drawings and the description below. Other aspects, features, and advantages will be apparent from the description and drawings, and from the claims.

Referring to FIG. 1, an article of footwear 10 includes a sole structure 100 and an upper 200 attached to the sole structure 100. The article of footwear 10, and components thereof, may be described as including an anterior end 12 associated with a forward-most point of the footwear 10, and a posterior end 14 corresponding to a rearward-most point of the footwear 10. As shown in the bottom view of FIG. 4, a longitudinal axis $A_{10}$ of the footwear 10 extends along a length of the footwear 10 from the anterior end 12 to the posterior end 14, and generally divides the footwear 10 into a lateral side 16 and a medial side 18. Accordingly, the lateral side 16 and the medial side 18 respectively correspond with opposite sides of the footwear 10 and extend from the anterior end 12 to the posterior end 14.

The article of footwear 10 may be divided into one or more regions along the longitudinal axis $A_{10}$. The regions may include a forefoot region 20, a mid-foot region 22, and a heel region 24. The forefoot region 20 may correspond with toes and joints connecting metatarsal bones with phalanx bones of a foot. The mid-foot region 22 may correspond with an arch area of the foot, and the heel region 24 may correspond with rear regions of the foot, including a calcaneus bone. In the illustrated example, the article of footwear also includes a posterior region 26 disposed adjacent to the heel region 24 at the posterior end 14 of the footwear. As will be discussed in greater detail below, the posterior region 26 is not directly associated with a corresponding region of the foot, but instead includes components of the footwear 10 that extend beyond the calcaneus bone and the calcaneal ("Achilles") tendon.

Figure 2:
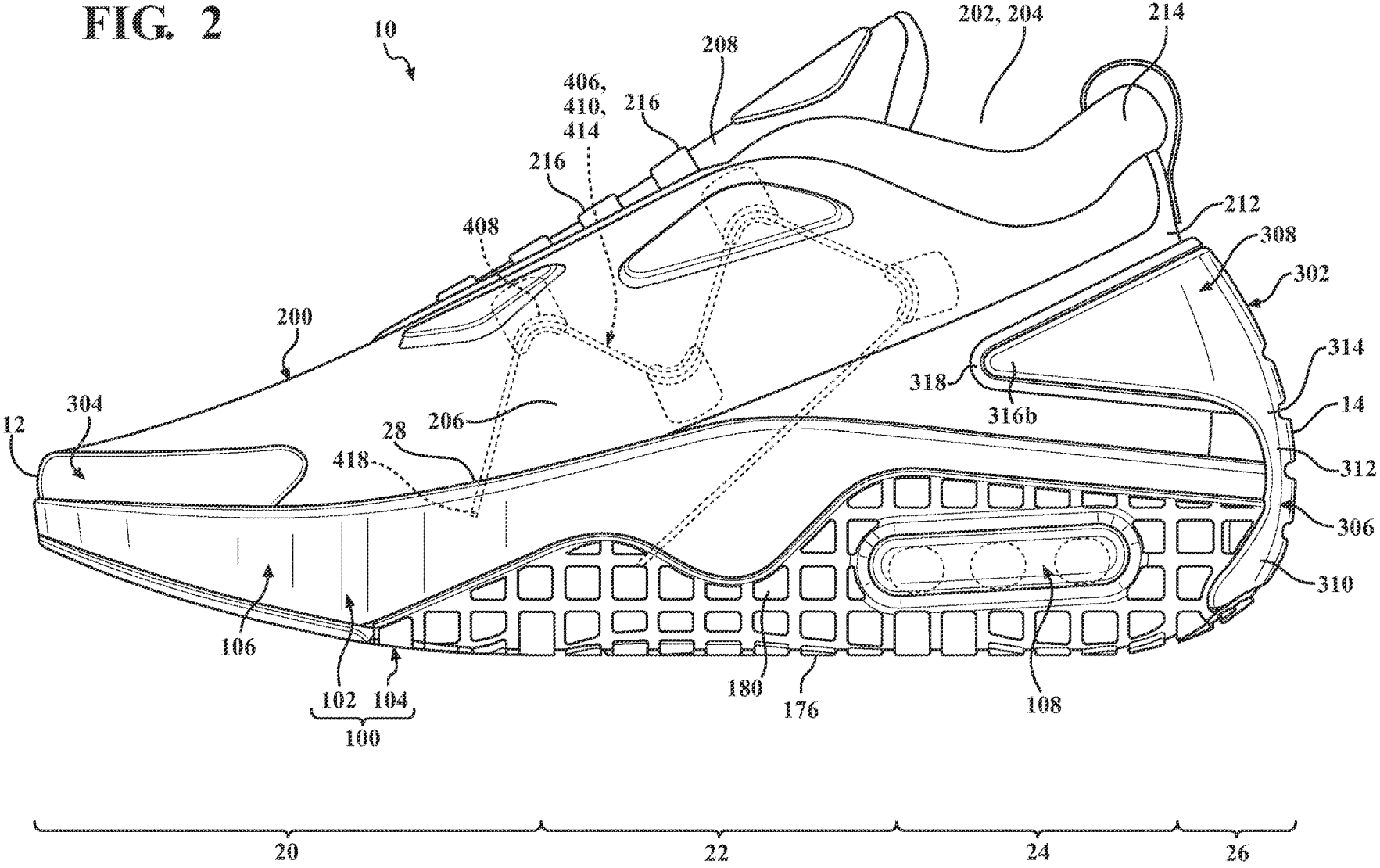
FIG. 2 is a medial side view of the article of footwear of FIG. 1.

With reference to FIGS. 1-2B, the sole structure 100 includes a midsole 102 configured to provide cushioning characteristics to the sole structure 100, and an outsole 104 configured to provide a ground-engaging surface of the article of footwear 10. Unlike conventional sole structures, the midsole 102 of the sole structure 100 may be formed compositely and include a plurality of subcomponents for providing desired forms of cushioning and support throughout the sole structure 100. For example, the midsole 102 includes a chassis 106 and a bladder 108, where the chassis 106 is configured to be attached to the upper 200 and provides an interface between the upper 200, the bladder 108, and the outsole 104.

Figure 6:
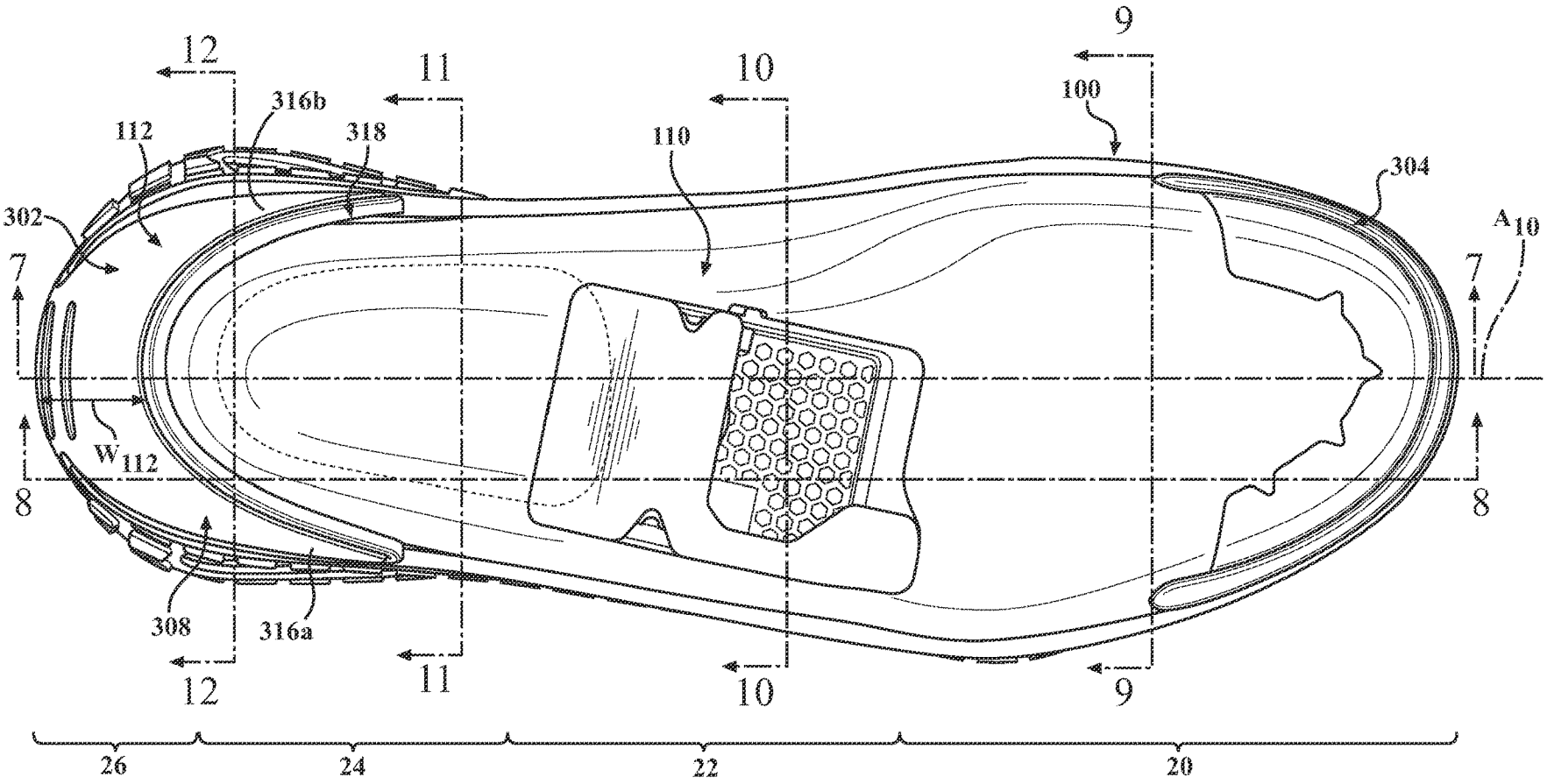
FIG. 6 is a top plan view of the sole structure of the article of footwear of FIG. 1.
Figure 7:
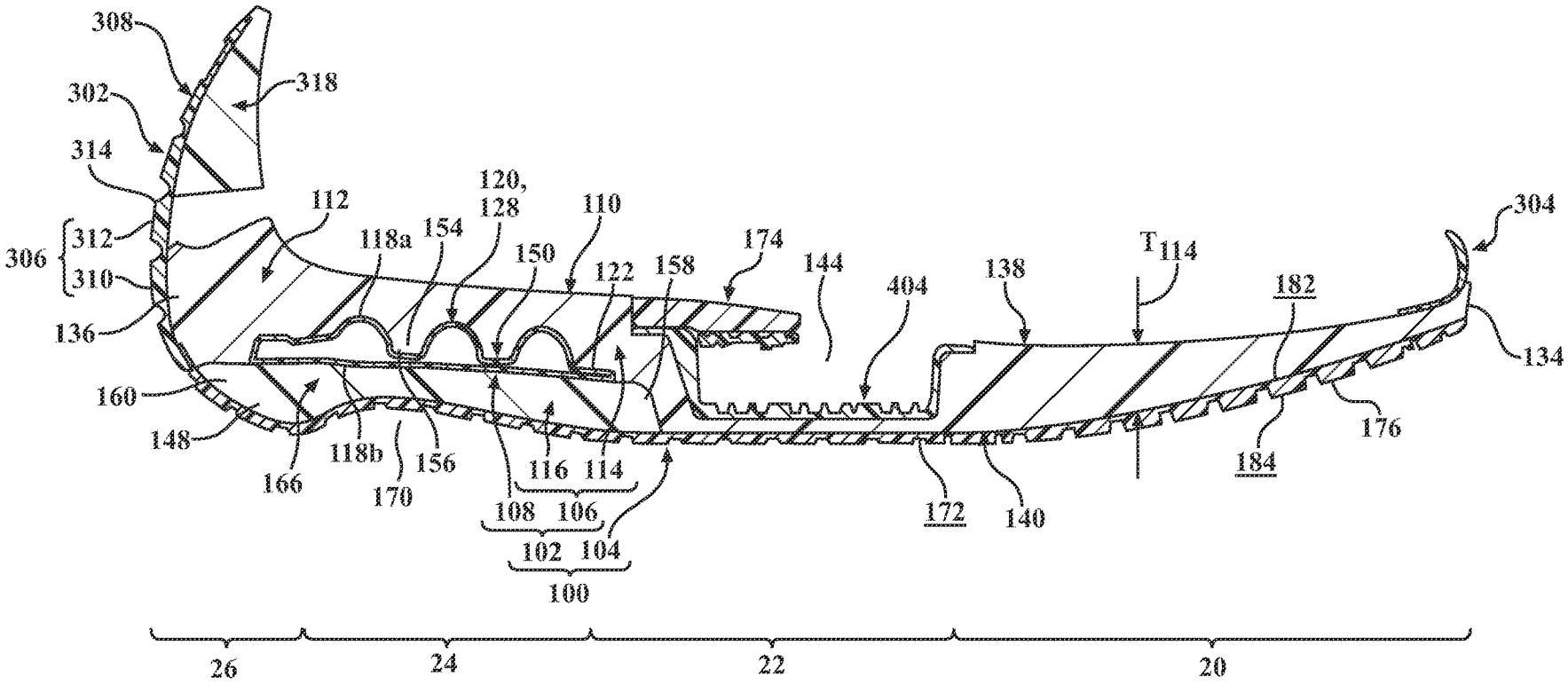
FIG. 7 is a cross-sectional view of the sole structure of the article of footwear of FIG. 1, taken along line 7-7 in FIG. 6.
Figure 8:
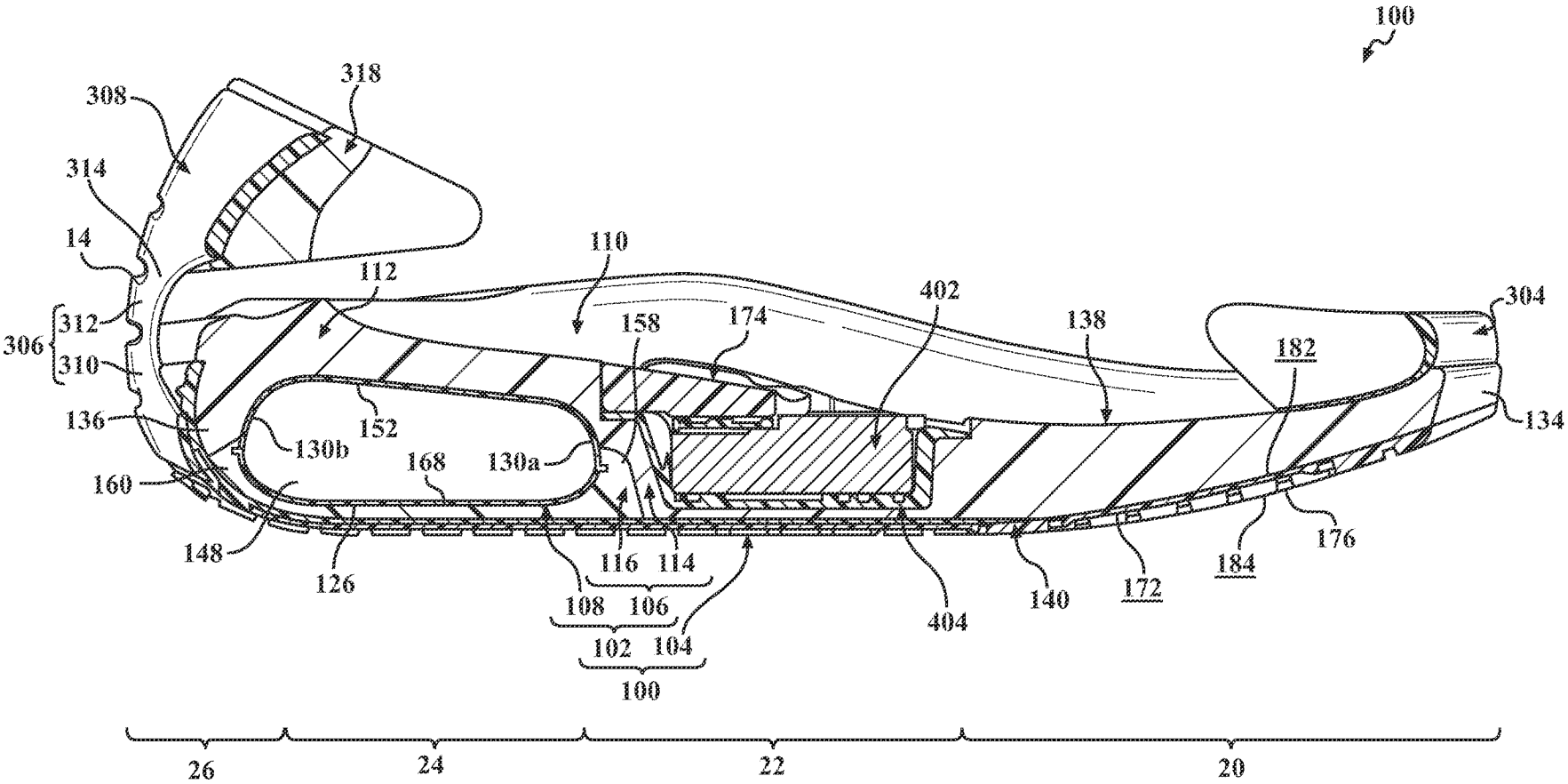
FIG. 8 is a cross-sectional view of the sole structure of the article of footwear of FIG. 1, taken along line 8-8 in FIG. 6.
Figure 10:
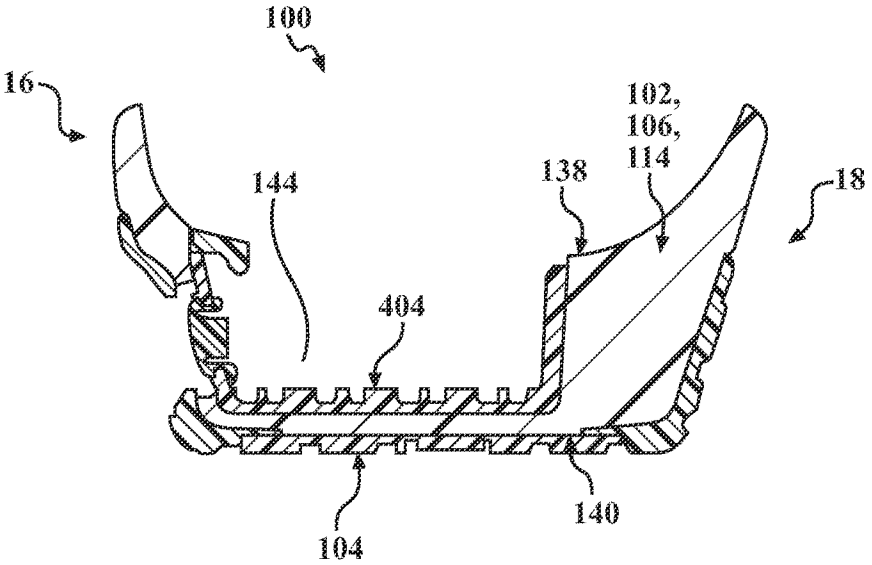
FIG. 10 is a cross-sectional view of the sole structure of the article of footwear of FIG. 1, taken along line 10-10 in FIG. 6.
Figure 9:
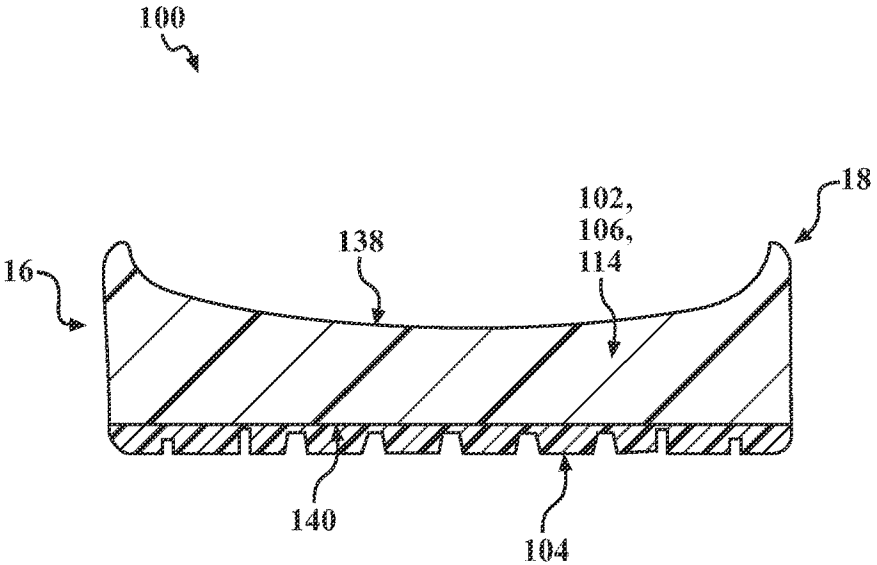
FIG. 9 is a cross-sectional view of the sole structure of the article of footwear of FIG. 1, taken along line 9-9 in FIG. 6.

As best shown in FIGS. 6-8, the midsole 102 of the present disclosure includes a footbed 110 configured to receive, support, and cushion the plantar surface of the foot, and a bolster 112 extending from the footbed at the posterior end 14. In the illustrated example, the footbed 110 extends along each of the forefoot region 20, the mid-foot region 22, and the heel region 24, while the bolster 112 is formed in the posterior region 26. The bolster 112 extends continuously around the footbed 110 in the heel region 24 from the lateral side 16 to the medial side 18. As shown in FIG. 6, the bolster 112 has maximum width W112 at the posterior end 14. The width W112 of the bolster 112 tapers as the bolster 112 wraps around the heel region 24 to each of the lateral side 16 and the medial side 18. Thus, unlike conventional sole structures that only extend beneath the foot, the sole structure 100 of the present example extends beyond the heel of the foot to provide posterior stability.

In the illustrated example, the midsole 102, and more particularly, the bolster 112 of the midsole 102, is formed as a composite structure including the chassis 106 and at least a portion of the bladder 108. As shown in FIG. 8 and described in greater detail below, the bladder 108 may extend at least partially into the bolster 112 so that when the article of footwear 10 is assembled, the bladder 108 is positioned closer to the posterior end 14 than the upper 200. In other words, an end of the bladder 108 extends beyond the end of the upper 200 at the posterior end 14 of the article of footwear 10. However, in some examples, the sole structure 100 may be formed without the bladder 108, where the footbed 110 and/or the bolster 112 are formed of elastomeric components.

The bladder 108 of the midsole 102 includes an opposing pair of barrier layers 118*a*, 118*b*, which can be joined to each other at discrete locations to define a chamber 120, a web area 122, and a peripheral seam 124. In the illustrated embodiment, the barrier layers 118*a*, 118*b* include a first, upper barrier layer 118*a* and a second, lower barrier layer 118*b*. Alternatively, the chamber 120 can be produced from any suitable combination of one or more barrier layers.

In some implementations, the upper barrier layer 118*a* and the lower barrier layer 118*b* cooperate to define a geometry (e.g., thicknesses, width, and lengths) of the chamber 120. For example, the web area 122 and the peripheral seam 124 may cooperate to bound and extend around the chamber 120 to seal the fluid (e.g., air) within the chamber 120. Thus, the chamber 120 is associated with an area of the bladder 108 where interior surfaces of the upper and lower barrier layers 118*a*, 118*b* are not joined together and, thus, are separated from one another.

As shown in FIGS. 7, 8, 11, and 12, a space formed between opposing interior surfaces of the upper and lower barrier layers 118*a*, 118*b* defines an interior void of the chamber 120. Similarly, exterior surfaces of the upper and lower barrier layers 118*a*, 118*b* define an exterior profile of the chamber 120. Thicknesses $T_{108}$ of the bladder 108 are defined by the distance between the upper and lower barrier layers 118*a*, 118*b* of the bladder 108, as discussed in greater detail below.

Figure 13:
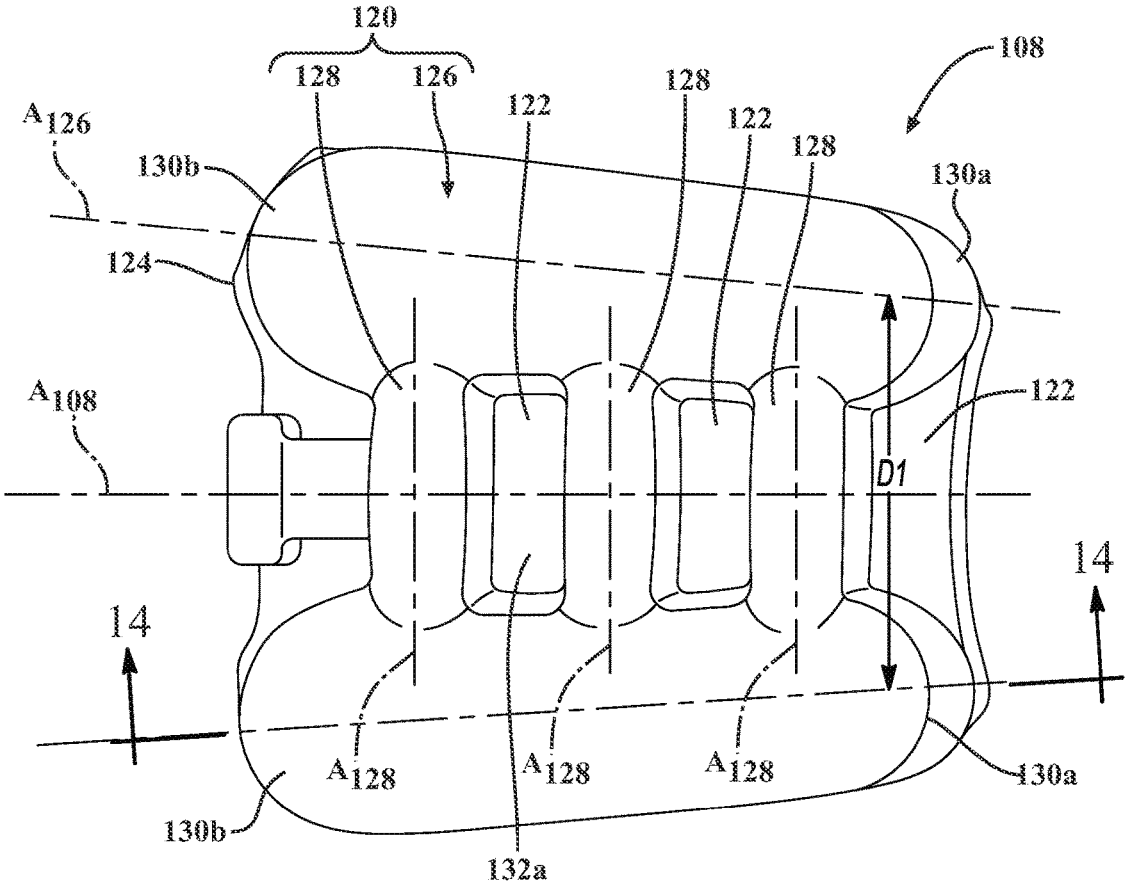
FIG. 13 is a top plan view of a bladder for use in a sole structure according to the principles of the present disclosure.
Figure 14:
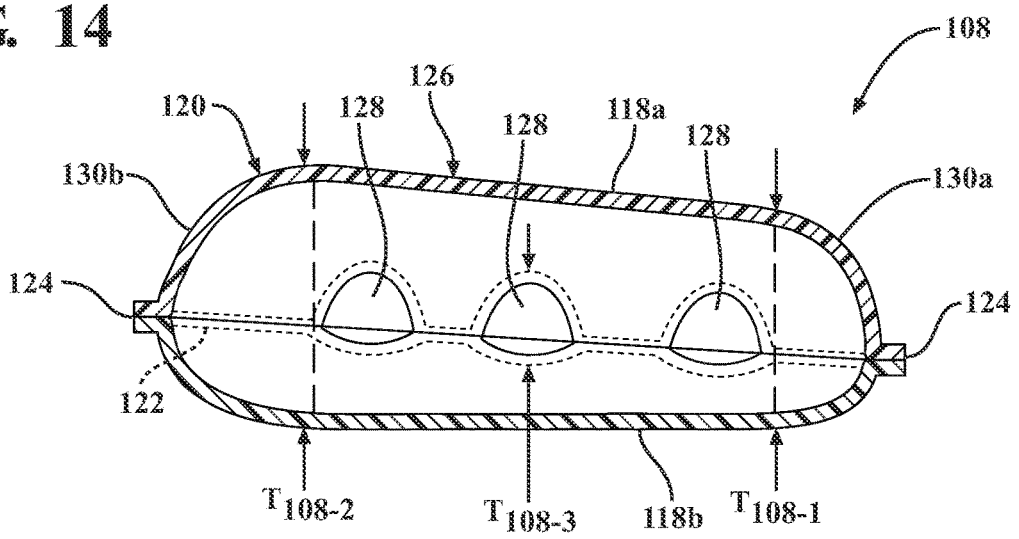
FIG. 14 is a cross-sectional view of the bladder of FIG. 13, taken along line 14-14 in FIG. 13.

Referring to FIGS. 13 and 14, the chamber 120 includes a plurality of segments 126, 128 that cooperate to provide characteristics of responsiveness and support to the midsole 102. Particularly, the segments 126, 128 may be described as including a pair of cushions 126 that are connected (i.e., in fluid communication) with each other by one or more conduits 128. Each of the cushions 126 includes a tubular body extending from a first terminal end 130*a* to a second terminal end 130*b* disposed at an opposite end of the tubular body from the first terminal end 130*a*. The cushion 126 defines a substantially circular cross section that extends along a longitudinal axis $A_{126}$. As shown, the thickness $T_{122}$ of the chamber 120 increases continuously along the longitudinal axis $A_{126}$ from a first thickness $T_{122\text{-}1}$ at the first terminal end 130*a* to a second thickness $T_{122\text{-}2}$ at the second terminal end 130*b*. Thus, the thickness of the chamber 120 may be described as tapering along the direction from the second terminal end 130*b* to the first terminal end 130*a*.

The first terminal end 130*a* and the second terminal end 130*b* of each cushion 126 are substantially dome-shaped, and each includes compound curvatures associated with the respective upper and lower barrier layers 118*a*, 118*b*. For example, the first terminal end 130*a* of each cushion 126 is formed where an end portion of the upper barrier layer 118*a* converges with and is joined to the lower barrier layer 118*b* at the peripheral seam 124 to enclose an anterior end of the cushion 126. Referring still to FIG. 8, the second terminal end 130*b* of each cushion 126 is formed where another end portion of the upper barrier layer 118*a* converges with and is joined to the lower barrier layer 118*b* at the peripheral seam 124 to enclose the opposite end of the cushion 126.

As provided above, each of the cushions 126 defines a respective longitudinal axis $A_{126}$ that extends from the first terminal end 130*a* to the second terminal end 130*b*. As best shown in FIG. 13, the cushions 126 are spaced apart from each other along a direction transverse to the longitudinal axes $A_{126}$ of each of the cushions 126. More particularly, when the bladder 108 is assembled within the sole structure 100, the cushions 126 are spaced apart from each other along a lateral direction of the article of footwear 10, substantially perpendicular to the longitudinal axis $A_{10}$ of the article of footwear 10. Furthermore, the longitudinal axes $A_{126}$ of the cushions 126 converge with each other and with the longitudinal axis $A_{10}$ of the article of footwear 10 along the direction from the posterior end 14 to the anterior end 12. Accordingly, a lateral distance D1 between the cushions 126 is greater at the second terminal ends 130*b* than at the first terminal ends 130*a*.

Figure 12:
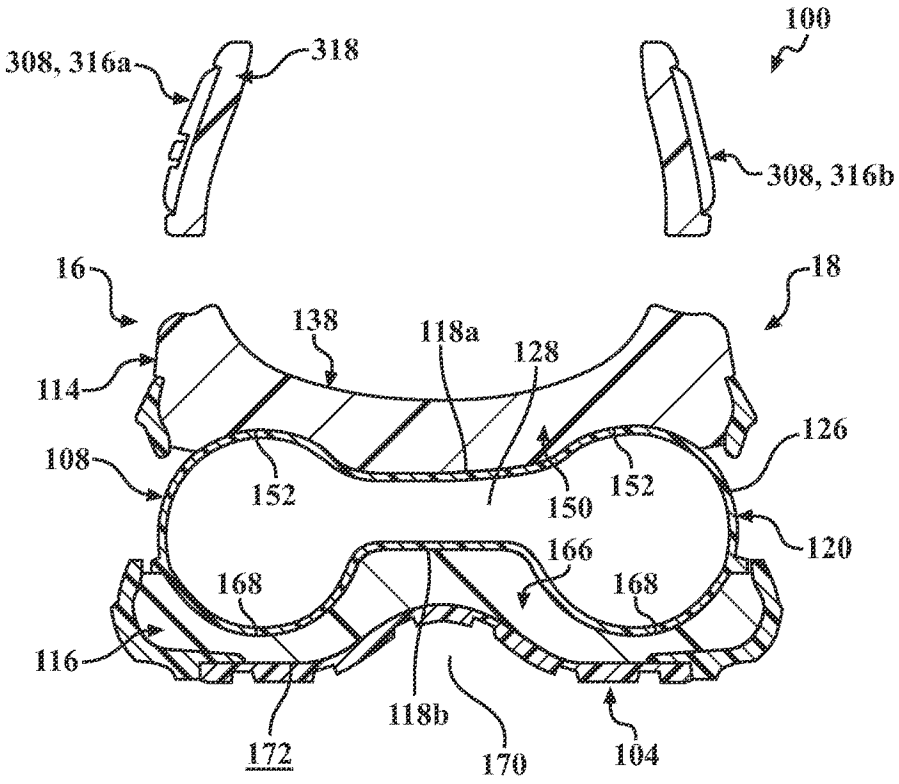
FIG. 12 is a cross-sectional view of the sole structure of the article of footwear of FIG. 1, taken along line 12-12 in FIG. 6.

With continued reference to FIGS. 12-14, the chamber 120 further includes at least one conduit 128 extending between and fluidly coupling the cushions 126. In the illustrated example, the chamber 120 includes a plurality of the conduits 128 connecting the cushions 126 to each other. The conduits 128 each extend along respective longitudinal axes $A_{128}$ that are transverse to the longitudinal axes $A_{126}$ of the cushions 126. As best shown in FIGS. 7 and 8, the conduits 128 include a first conduit 128 extending between the cushions 126 adjacent to the first terminal ends 130*a*, a second conduit 128 extending between the cushions 126 adjacent to the second terminal ends 130*b*, and a third conduit 128 disposed between the first conduit 128 and the second conduit 128 and connecting intermediate portions of the cushion 126. Accordingly, the first conduit 128 and the second conduit 128 are disposed on opposite sides of the third conduit 128.

As best shown in FIGS. 7, 12, and 14, the conduits 128 are defined by the cooperation of the upper barrier layer 118*a* and the lower barrier layer 118*b*. As shown in FIG. 14, the upper barrier layer 118*a* and the lower barrier layer 118*b* are formed to provide a plurality of semi-cylindrically shaped conduits 128, each having a substantially similar third thickness $T_{108\text{-}3}$ that is less than the first thickness $T_{108\text{-}1}$ and the second thickness $T_{108\text{-}2}$ of the cushions 126. A profile of each of the conduits 128 is defined by the upper barrier layer 118*a*, whereby the upper barrier layer 118*a* is molded to define a curved upper portion of each conduit 128 while the lower barrier layer 118*b* is provided as a substantially flat lower portion of each of the conduits 128. Although the lower barrier layer 118*b* is initially provided in a substantially flat state, the lower barrier layer 118*b* may bulge from the web area 122 when the chamber 120 is pressurized and the lower barrier layer 118*b* is biased apart from the upper barrier layer 118*a*, as illustrated in FIG. 14.

With reference to FIGS. 11-14, the web area 122 is formed at a bonded region of the upper barrier layer 118*a* and the lower barrier layer 118*b*, and extends between and connects each of the segments 126, 128 of the chamber 120. Particularly, the web area 122 includes an anterior portion extending between and connecting the first terminal ends 130*a* of the respective cushions 126, and defines a first terminal edge at an anterior end of the bladder 108. A posterior portion of the web area 122 extends between and connects the second terminal ends 130*b* of the cushions 126 and forms a second terminal edge at a posterior end of the bladder 108. Intermediate portions of the web area 122 extend between and connect adjacent ones of the conduits 128 and the cushions 126. Accordingly, the intermediate portions of the web area 122 may be completely surrounded by the chamber 120. In the illustrated example, the web area 122 is disposed vertically intermediate with respect to the thickness $T_{108}$ of the bladder 108.

In the illustrated example, the web area 122 and the cushions 126 of the chamber 120 cooperate to define an upper pocket 132*a* on a first side of the bladder 108 associated with the upper barrier layer 118*a*, and a lower pocket 132*b* on a second side of the bladder 108 associated with the lower barrier layer 118*b*. Here, the conduits 128 may be disposed within the upper pocket 132*a* to form an alternating series of bulges and recesses along a length of the upper pocket 132*a*. As described in greater detail below, the chassis 106 may include one or more features configured to mate with the upper pocket 132*a* when the sole structure 100 is assembled. For instance, the chassis 106 may include protrusions and indentations configured to engage the bulges and recesses formed by the conduits 128 of the bladder 108.

As used herein, the term "barrier layer" (e.g., barrier layers 118*a*, 118*b*) encompasses both monolayer and multilayer films. In some embodiments, one or both of barrier layers 118*a*, 118*b* are each produced (e.g., thermoformed or blow molded) from a monolayer film (a single layer). In other embodiments, one or both of barrier layers 118*a*, 118*b* are each produced (e.g., thermoformed or blow molded) from a multilayer film (multiple sublayers). In either aspect, each layer or sublayer can have a film thickness ranging from about 0.2 micrometers to about 1 millimeter. In further embodiments, the film thickness for each layer or sublayer can range from about 0.5 micrometers to about 500 micrometers. In yet further embodiments, the film thickness for each layer or sublayer can range from about 1 micrometer to about 100 micrometers.

One or both of barrier layers 118*a*, 118*b* can independently be transparent, translucent, and/or opaque. For example, the upper barrier layer 118*a* may be transparent, while the lower barrier layer 118*b* is opaque. As used herein, the term "transparent" for a barrier layer and/or a fluid-filled chamber means that light passes through the barrier layer in substantially straight lines and a viewer can see through the barrier layer. In comparison, for an opaque barrier layer, light does not pass through the barrier layer and one cannot see clearly through the barrier layer at all. A translucent barrier layer falls between a transparent barrier layer and an opaque barrier layer, in that light passes through a translucent layer but some of the light is scattered so that a viewer cannot see clearly through the layer.

Barrier layers 118*a*, 118*b* can each be produced from an elastomeric material that includes one or more thermoplastic polymers and/or one or more cross-linkable polymers. In an aspect, the elastomeric material can include one or more thermoplastic elastomeric materials, such as one or more thermoplastic polyurethane (TPU) copolymers, one or more ethylene-vinyl alcohol (EVOH) copolymers, and the like.

As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocynaurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4, 4'-diisocyanate (DDDI), 4,4'-dibenzyl diisocyanate (DBDI), 4-chloro-1,3-phenylene diisocyanate, and combinations thereof. In some embodiments, the copolymer chains are substantially free of aromatic groups.

In particular aspects, the polyurethane polymer chains are produced from diisocynates including HMDI, TDI, MDI, H12 aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In another aspect, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials as well as with the TPU copolymers described herein and optionally including combinations of polyimides and crystalline polymers, are also suitable.

The barrier layers 118*a*, 118*b* may include two or more sublayers (multilayer film) such as shown in Mitchell et al., U.S. Pat. No. 5,713,141 and Mitchell et al., U.S. Pat. No. 5,952,065, the disclosures of which are incorporated by reference in their entirety. In embodiments where the barrier layers 118*a*, 118*b* include two or more sublayers, examples of suitable multilayer films include microlayer films, such as those disclosed in Bonk et al., U.S. Pat. No. 6,582,786, which is incorporated by reference in its entirety. In further embodiments, barrier layers 118*a*, 118*b* may each independently include alternating sublayers of one or more TPU copolymer materials and one or more EVOH copolymer materials, where the total number of sublayers in each of barrier layers 118*a*, 118*b* includes at least four (4) sublayers, at least ten (10) sublayers, at least twenty (20) sublayers, at least forty (40) sublayers, and/or at least sixty (60) sublayers.

The chamber 120 can be produced from the barrier layers 118*a*, 118*b* using any suitable technique, such as thermoforming (e.g. vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In an aspect, barrier layers 118*a*, 118*b* can be produced by co-extrusion followed by vacuum thermoforming to produce an inflatable chamber 120, which can optionally include one or more valves (e.g., one way valves) that allows the chamber 120 to be filled with the fluid (e.g., gas).

The chamber 120 can be provided in a fluid-filled (e.g., as provided in footwear 10) or in an unfilled state. The chamber 120 can be filled to include any suitable fluid, such as a gas or liquid. In an aspect, the gas can include air, nitrogen ($N_2$), or any other suitable gas. In other aspects, the chamber 120 can alternatively include other media, such as pellets, beads, ground recycled material, and the like (e.g., foamed beads and/or rubber beads). The fluid provided to the chamber 120 can result in the chamber 120 being pressurized. Alternatively, the fluid provided to the chamber 120 can be at atmospheric pressure such that the chamber 120 is not pressurized but, rather, simply contains a volume of fluid at atmospheric pressure.

The chamber 120 desirably has a low gas transmission rate to preserve its retained gas pressure. In some embodiments, the chamber 120 has a gas transmission rate for nitrogen gas that is at least about ten (10) times lower than a nitrogen gas transmission rate for a butyl rubber layer of substantially the same dimensions. In an aspect, the chamber 120 has a nitrogen gas transmission rate of 15 cubic-centimeter/square-meter·atmosphere·day ($cm^3/m^2 \cdot atm \cdot day$) or less for an average film thickness of 500 micrometers (based on thicknesses of barrier layers 118*a*, 118*b*). In further aspects, the transmission rate is 10 $cm^3/m^2 \cdot atm \cdot day$ or less, 5 $cm^3/m^2 \cdot atm \cdot day$ or less, or 1 $cm^3/m^2 \cdot atm \cdot day$ or less.

In some implementations, the upper and lower barrier layers 118*a*, 118*b* are formed by respective mold portions each defining various surfaces for forming depressions and pinched surfaces corresponding to locations where the web area 122 and/or the peripheral seam 124 are formed when the upper barrier layer 118*a* and the lower barrier layer 118*b* are joined and bonded together. In some implementations, adhesive bonding joins the upper barrier layer 118*a* and the lower barrier layer 118*b* to form the web area 122 and the peripheral seam 124. In other implementations, the upper barrier layer 118*a* and the lower barrier layer 118*b* are joined to form the web area 122 and the peripheral seam 124 by thermal bonding. In some examples, one or both of the barrier layers 118*a*, 118*b* are heated to a temperature that facilitates shaping and melding. In some examples, the barrier layers 118*a*, 118*b* are heated prior to being located between their respective molds. In other examples, the mold may be heated to raise the temperature of the barrier layers 118*a*, 118*b*. In some implementations, a molding process used to form the fluid-filled chamber 120 incorporates vacuum ports within mold portions to remove air such that the upper and lower barrier layers 118*a*, 118*b* are drawn into contact with respective mold portions. In other implementations, fluids such as air may be injected into areas between the upper and lower barrier layers 118*a*, 118*b* such that pressure increases cause the barrier layers 118*a*, 118*b* to engage with surfaces of their respective mold portions.

In the illustrated example, the chassis 106 extends continuously from the anterior end 12 to the posterior end 14, and is configured to receive and support the bladder 108 therein. As shown, the chassis 106 is formed as a composite structure including a cushioning element 114 and a cradle 116 received at least partially within the cushioning element 114. While the cushioning element 114 and the cradle 116 of the illustrated example are shown as separate components that cooperate to form the chassis 106, in some examples, the chassis 106 may be formed as a unitary body.

The cushioning element 114 is formed of an elastomeric material, and extends continuously from a first end 134 at the anterior end 12 to a second end 136 at the posterior end 14. The cushioning element 114 includes a top side 138 and a bottom side 140 formed on an opposite side of the cushioning element 114 from the top side 138, whereby a distance from the top side 138 to the bottom side 140 defines an overall thickness $T_{114}$ of the cushioning element 114. The cushioning element 114 further includes a peripheral wall 142 extending from the top side 138 to the bottom side 140, and defining an outer periphery of the cushioning element 114.

Figure 4:
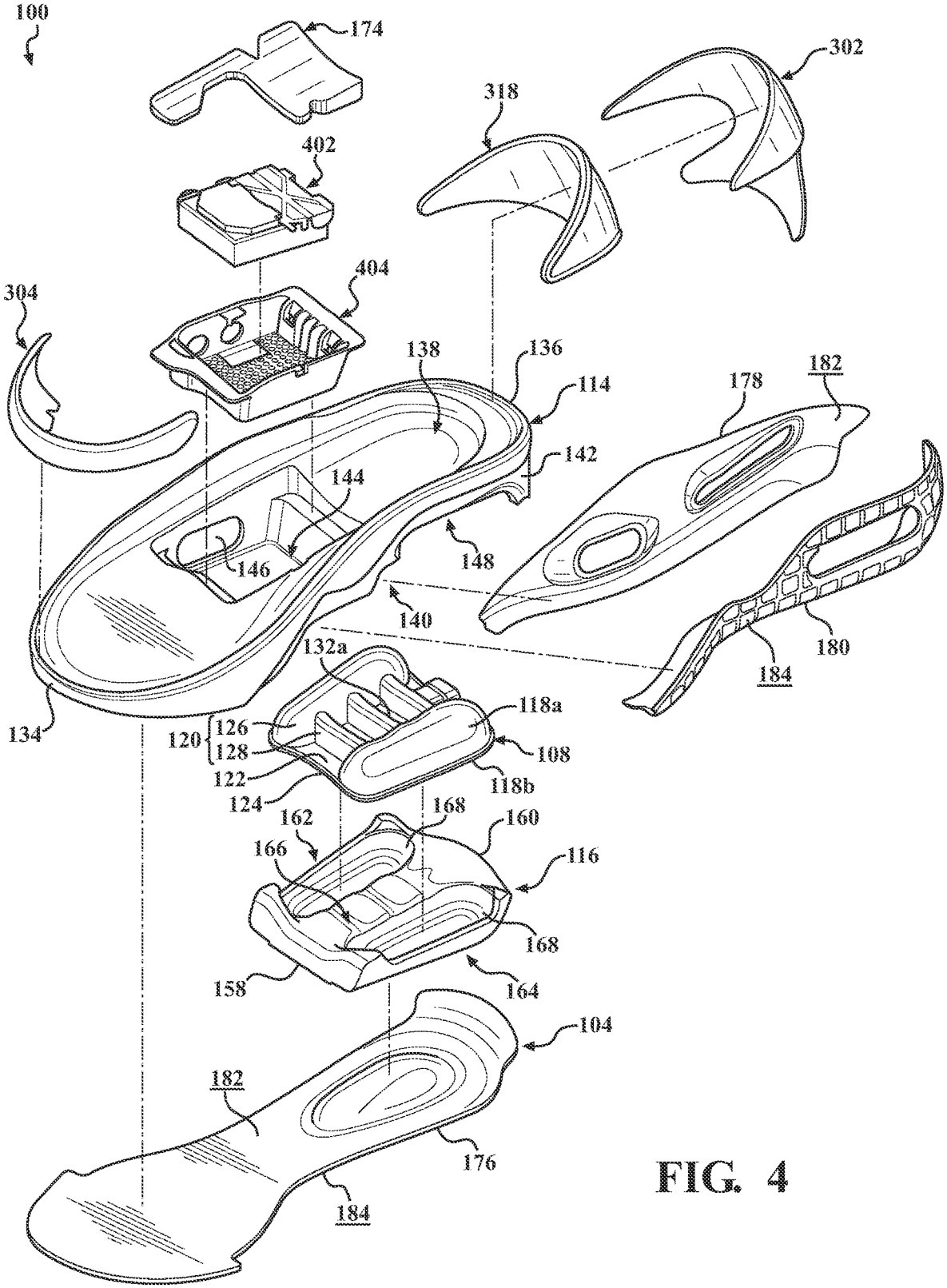
FIG. 4 is a top-anterior perspective exploded view of a sole structure of the article of footwear of FIG. 1.

With reference to FIG. 4, the top side 138 of the cushioning element 114 forms an upper surface of the footbed 110 extending from the forefoot region 20 though the heel region 24. As shown, an upper receptacle 144 is formed in the top side 138 of the cushioning element 114 in the mid-foot region 22. The upper receptacle 144 is configured to receive components of the tensioning system 400 therein. For instance, in the illustrated example the tensioning system 400 includes a tensioning device 402 and a capsule 404 for supporting the tensioning device 402. Here, the receptacle 144 of the cushioning element 110 has a shape corresponding to an exterior shape of the capsule 404, such that the capsule 404 is partially encapsulated within the upper receptacle 144 when the sole structure 100 is assembled. In the illustrated example, the upper receptacle 144 includes an aperture 146 formed through the peripheral wall 142 of the cushioning element 114, which provides access to controls of the tensioning device 402 from the exterior of the article of footwear 10 when the article of footwear 10 is assembled.

Figure 5:
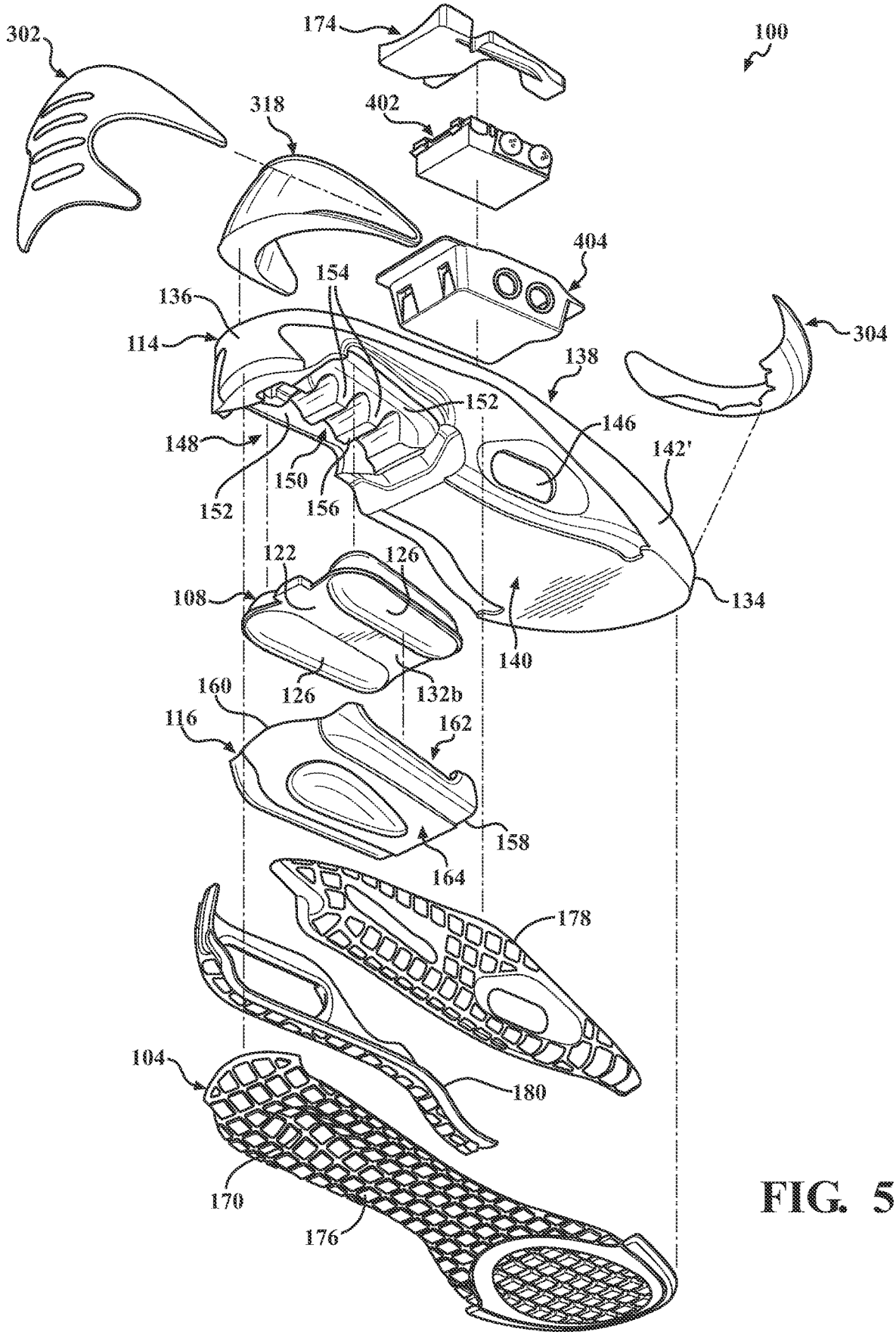
FIG. 5 is a bottom-posterior perspective exploded view of the sole structure of the article of footwear of FIG. 1.

Referring now to FIG. 5, the bottom side 140 of the cushioning element 114 includes a lower receptacle 148 configured to receive the bladder 108 therein. In the illustrated example, the receptacle includes an upper central spine 150 disposed between a pair of upper channels 152. Generally, the upper central spine 150 is configured to at least partially mate with the upper pocket 132*a* formed by the upper barrier layer 118*a* of the bladder 108. As shown, the upper central spine 150 includes a plurality of ribs 154 arranged in series along a direction of the longitudinal axis $A_{10}$. Each of the ribs 154 extends from the upper central spine 150 to a distal end 156. Here, the ribs 154 are each configured to be received between adjacent ones of the conduits 128 of the bladder 108. Accordingly, sides of the ribs 154 may be concave to receive corresponding convex portions of the conduits 128. As best shown in the cross sectional view of FIG. 7, the ribs 154 may extend fully between the conduits 128, such that the distal ends 156 of the ribs 154 face and contact the web area 122 when the sole structure 100 is assembled.

With continued reference to FIGS. 7 and 8, the lower receptacle 148 extends along the heel region 24 and at least partially into the posterior region 26. For example, the upper central spine 150 of the receptacle 148 is disposed within the heel region 24, while the upper channels 152 extend beyond the heel region 24 and into the posterior region 26. Thus, the upper central spine 150 is positioned within the footbed 110 of the sole structure 100, while the upper channels 152 extend at least partially into the bolster 112. When the sole structure 100 is assembled, the cushions 126 of the bladder 108 are received within the upper channels 152 such that the second terminal ends 130*b* of the cushions 126 also extend partially into the posterior region 26 of the sole structure 100. As such, the second terminal ends 130*b* of the cushions 126 cooperate with the second end 136 of the cushioning element 114 to form a portion of the bolster 112 at the posterior end 14 of the sole structure 100.

As best shown in FIGS. 7 and 8, the cradle 116 cooperates with the cushioning element 114 to form the chassis 106. Particularly, the cradle 116 is configured to be received within the lower receptacle 148 of the cushioning element 114 and forms a bottom portion of the chassis 106 in the heel region 24 and the posterior region 26. Accordingly, when the sole structure 100 is assembled, the bladder 108 is interposed between the cushioning element 114 and the cradle 116. In the illustrated example, the cradle 116 extends from a first end 158 in the heel region 24 to a second end 160 in the posterior region 26. Here, the second end 160 cooperates with the second end 136 of the cushioning element 114 and the second terminal ends 130*b* of the cushions 126 to form the bolster 112 of the sole structure 100.

The cradle 116 may be described as including a top side 162 and a bottom side 164 formed on an opposite side of the cradle 116 from the top side 162. The top side 162 of the cradle 116 includes a lower central spine 166 disposed between a pair of lower channels 168. Here, the lower central spine 166 is configured to face or oppose the upper central spine 150 and the lower channels 168 are configured to oppose or face the upper channels 152 when the sole structure 100 is assembled. Particularly, the lower central spine 166 mates with the lower pocket 132*b* of the bladder 108 and the lower channels 168 receive lower portions of the cushions 126 of the bladder 108 (e.g., the lower barrier layer 118*b*).

As shown in FIGS. 6 and 7, the bottom side 140 of the cradle 116 may include a cavity 170 formed on an opposite side from the lower central spine 166. The cavity 170 may be ellipsoidal in shape, and extends along a central portion of the cradle 116 from the first end 158 to the second end 160. When the sole structure 100 is assembled and the cradle 116 is received within the lower receptacle 148, the bottom side 164 of the cradle 116 is flush with the bottom side 140 of the cushioning element 114 to form a substantially continuous ground-facing surface 172 along the bottom of the midsole 102 for attaching the outsole 104.

Optionally, the midsole 102 may further include a cover 174 for the upper receptacle 144. As shown in FIGS. 7 and 8, the cover 174 is disposed above the tensioning device 402 and the capsule 404 on the top side 138 of the cushioning element 114 to provide a resilient interface between the tensioning device 402 and the plantar surface of the foot. Here, a top side of the cover 174 is flush with the top side 138 of the cushioning element 114 to form a substantially continuous foot-supporting surface of the midsole 102 along the footbed 110.

As described above, the cushioning element 114, the cradle 116, and the cover 174 include resilient polymeric materials, such as foam or rubber, to impart properties of cushioning, responsiveness, and energy distribution to the foot of the wearer. Example resilient polymeric materials for the cushioning element 114 and cradle 116 may include those based on foaming or molding one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

In some aspects, the one or more polymers may include olefinic homopolymers, olefinic copolymers, or blends thereof. Examples of olefinic polymers include polyethylene, polypropylene, and combinations thereof. In other aspects, the one or more polymers may include one or more ethylene copolymers, such as, ethylene-vinyl acetate (EVA) copolymers, EVOH copolymers, ethylene-ethyl acrylate copolymers, ethylene-unsaturated mono-fatty acid copolymers, and combinations thereof.

In further aspects, the one or more polymers may include one or more polyacrylates, such as polyacrylic acid, esters of polyacrylic acid, polyacrylonitrile, polyacrylic acetate, polymethyl acrylate, polyethyl acrylate, polybutyl acrylate, polymethyl methacrylate, and polyvinyl acetate; including derivatives thereof, copolymers thereof, and any combinations thereof.

In yet further aspects, the one or more polymers may include one or more ionomeric polymers. In these aspects, the ionomeric polymers may include polymers with carboxylic acid functional groups, sulfonic acid functional groups, salts thereof (e.g., sodium, magnesium, potassium, etc.), and/or anhydrides thereof. For instance, the ionomeric polymer(s) may include one or more fatty acid-modified ionomeric polymers, polystyrene sulfonate, ethylene-methacrylic acid copolymers, and combinations thereof.

In further aspects, the one or more polymers may include one or more styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

In further aspects, the one or more polymers may include one or more polyamide copolymers (e.g., polyamide-polyether copolymers) and/or one or more polyurethanes (e.g., crosslinked polyurethanes and/or thermoplastic polyurethanes). Alternatively, the one or more polymers may include one or more natural and/or synthetic rubbers, such as butadiene and isoprene.

When the resilient polymeric material is a foamed polymeric material, the foamed material may be foamed using a physical blowing agent which phase transitions to a gas based on a change in temperature and/or pressure, or a chemical blowing agent which forms a gas when heated above its activation temperature. For example, the chemical blowing agent may be an azo compound such as azodicarbonamide, sodium bicarbonate, and/or an isocyanate.

In some embodiments, the foamed polymeric material may be a crosslinked foamed material. In these embodiments, a peroxide-based crosslinking agent such as dicumyl peroxide may be used. Furthermore, the foamed polymeric material may include one or more fillers such as pigments, modified or natural clays, modified or unmodified synthetic clays, talc glass fiber, powdered glass, modified or natural silica, calcium carbonate, mica, paper, wood chips, and the like.

The resilient polymeric material may be formed using a molding process. In one example, when the resilient polymeric material is a molded elastomer, the uncured elastomer (e.g., rubber) may be mixed in a Banbury mixer with an optional filler and a curing package such as a sulfur-based or peroxide-based curing package, calendared, formed into shape, placed in a mold, and vulcanized.

In another example, when the resilient polymeric material is a foamed material, the material may be foamed during a molding process, such as an injection molding process. A thermoplastic polymeric material may be melted in the barrel of an injection molding system and combined with a physical or chemical blowing agent and optionally a crosslinking agent, and then injected into a mold under conditions which activate the blowing agent, forming a molded foam.

Optionally, when the resilient polymeric material is a foamed material, the foamed material may be a compression molded foam. Compression molding may be used to alter the physical properties (e.g., density, stiffness and/or durometer) of a foam, or to alter the physical appearance of the foam (e.g., to fuse two or more pieces of foam, to shape the foam, etc.), or both.

The compression molding process desirably starts by forming one or more foam preforms, such as by injection molding and foaming a polymeric material, by forming foamed particles or beads, by cutting foamed sheet stock, and the like. The compression molded foam may then be made by placing the one or more preforms formed of foamed polymeric material(s) in a compression mold, and applying sufficient pressure to the one or more preforms to compress the one or more preforms in a closed mold. Once the mold is closed, sufficient heat and/or pressure is applied to the one or more preforms in the closed mold for a sufficient duration of time to alter the preform(s) by forming a skin on the outer surface of the compression molded foam, fuse individual foam particles to each other, permanently increase the density of the foam(s), or any combination thereof. Following the heating and/or application of pressure, the mold is opened and the molded foam article is removed from the mold.

Figure 3:
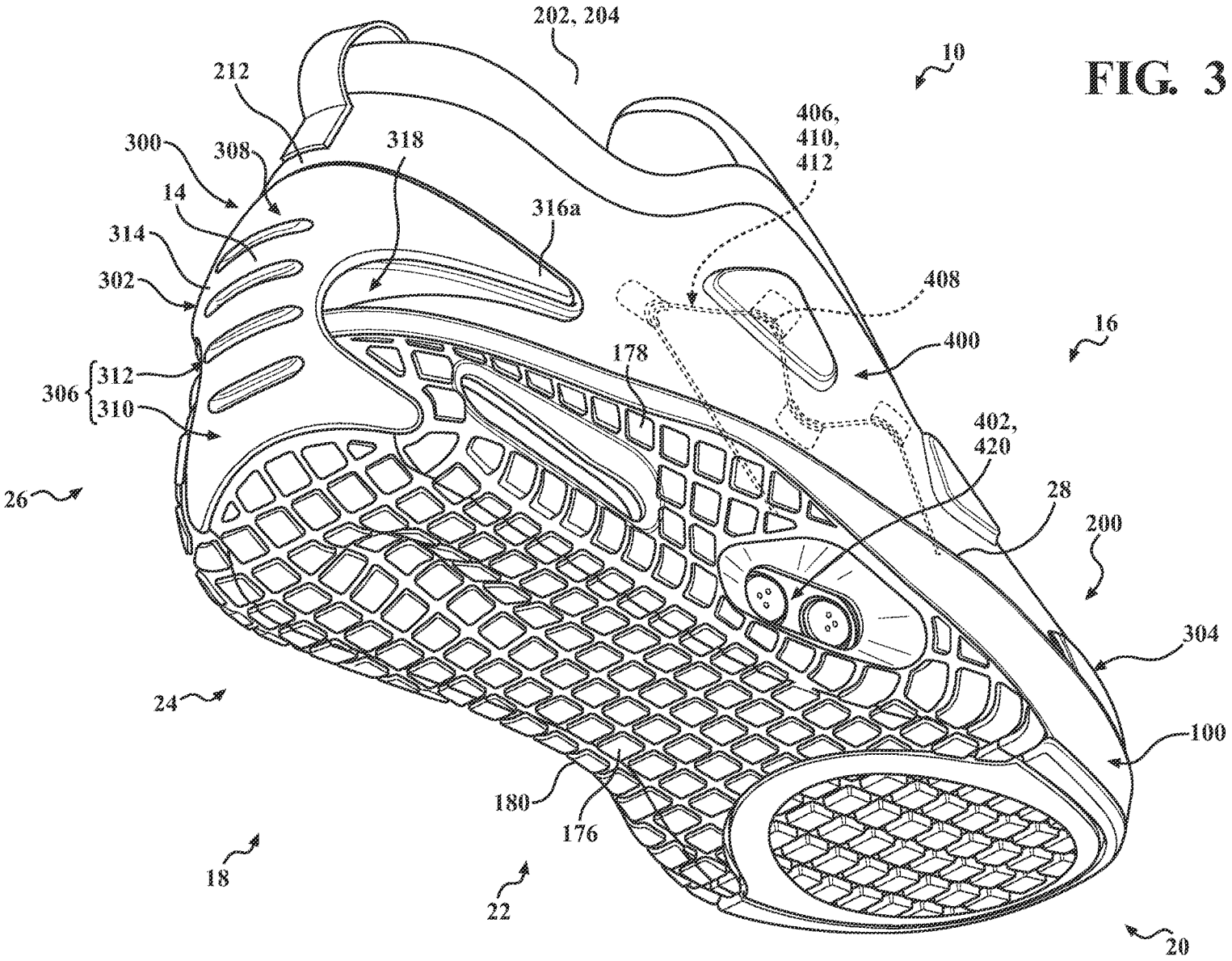
FIG. 3 is a bottom-posterior perspective view of the article of footwear of FIG. 1.

With reference to FIGS. 3-5, the outsole 104 extends continuously along the length of the sole structure 100. In the illustrated example, the outsole 104 includes a plantar portion 176 extending along the ground-facing surface 172 of the midsole 102, and optional side portions 178, 180 extending from the plantar portion 176 on opposite sides 16, 18 of the article of footwear 10. The outsole 104 and the components 176, 178, 180 of the outsole 104 may be described as including an inner surface 182 facing the midsole 102 and an exterior surface 184 formed on an opposite side from the inner surface 182.

Figure 11:
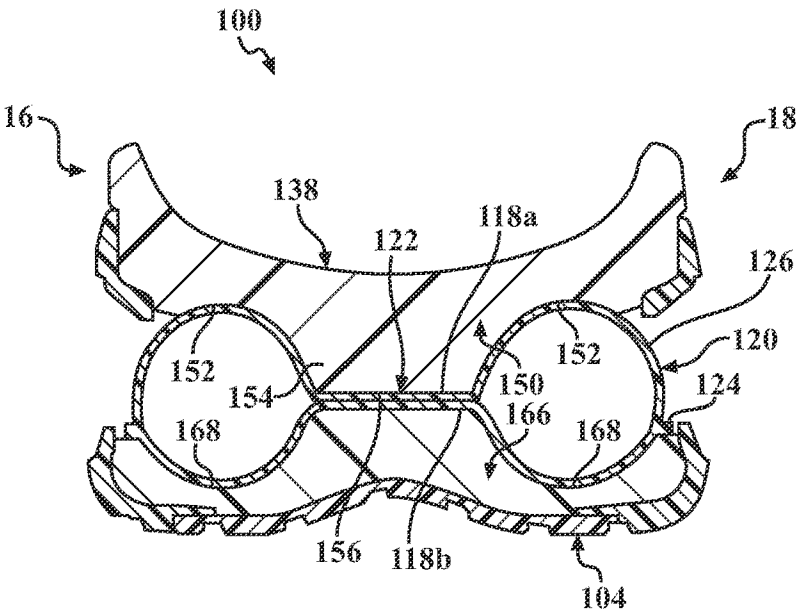
FIG. 11 is a cross-sectional view of the sole structure of the article of footwear of FIG. 1, taken along line 11-11 in FIG. 6.

As best shown in FIGS. 7, 11, and 12, the plantar portion 176 of the outsole 104 substantially conforms to the ground-facing surface 172 of the midsole 102 such that the outsole 104 extends into the cavity 170 of the cradle 116 in the heel region 24. Here, the exterior surface 184 of the outsole 104 is spaced apart from the ground surface in the heel region 24. As discussed above, the cavity 170 of the cradle 116 is disposed on an opposite side of the cradle 116 from the lower central spine 166, which mates with the lower pocket **132*b* of the bladder 108 and abuts the web area 122. Accordingly, the web area 122 of the bladder 108 is disposed above the cavity 170 and provides a trampoline-like structure across the heel region 24**.

The side portions 178, 180 include a lateral side portion 178 extending from the plantar portion 176 along a lateral side 16 of the midsole 102, and a medial side portion 180 extending from the plantar portion 176 along a medial side 18 of the midsole 102.

The upper 200 forms an enclosure having a plurality of components that cooperate to define an interior void 202 and an ankle opening 204, which cooperate to receive and secure a foot for support on the sole structure 100. For example, the upper 200 includes a pair of quarter panels 206 in the mid-foot region 22 on opposite sides of the interior void 202. A throat 208 extends across the top of the upper 200 and defines an instep region extending between the quarter panels 206 from the ankle opening 204 to the forefoot region 20. In the illustrated example, the throat 208 is enclosed with a material panel extending between the opposing quarter panels in the instep region to cover the interior void 202. Here, the material panel covering the throat 208 may be formed of a material having a higher modulus of elasticity than the material forming the quarter panels 206.

The upper 200 of the article of footwear 10 may be further described as including heel side panels 210 extending through the heel region 24 along the lateral and medial sides 16, 18 of the ankle opening 204. A heel panel 212 wraps around the posterior end 14 of the footwear 10 and connects the heel side panels 210. Uppermost edges of the throat 208, the heel side panels 210, and the heel panel 212 cooperate to form a collar 214, which defines the ankle opening 204 of the interior void 202.

Optionally, the upper 200 may include a plurality of tensioning straps 216 arranged in series along the throat 208. As shown in FIG. 4, each of the tensioning straps 216 extends across the throat 208 from a first end on the lateral side 16 to a second end on the medial side 18. In the illustrated example, the tensioning straps 216 are provided as passive tensioning elements. In other words, the tensioning straps 216 are not actively adjusted, but instead provide continuous tensioning over the throat 208 of the upper 200. The tensioning straps 216 may include an elastomeric material configured to provide continuous tension across the throat 208 of the upper.

The upper 200 may be formed from one or more materials that are stitched or adhesively bonded together to define the interior void 202. Suitable materials of the upper 200 may include, but are not limited to, textiles, foam, leather, and synthetic leather. The example upper 200 may be formed from a combination of one or more substantially inelastic or non-stretchable materials and one or more substantially elastic or stretchable materials disposed in different regions of the upper 200 to facilitate movement of the article of footwear 10 between the tightened state and the loosened state. The one or more elastic materials may include any combination of one or more elastic fabrics such as, without limitation, spandex, elastane, rubber or neoprene. The one or more inelastic materials may include any combination of one or more of thermoplastic polyurethanes, nylon, leather, vinyl, or another material/fabric that does not impart properties of elasticity.

The article of footwear 10 further includes a support system 300 connecting the sole structure 100 to the upper 200 and providing reinforcement and support to the upper 200. As shown, the support system includes a buttress or brace 302 connecting the sole structure 100 to the upper 200 at the posterior end 14, and an optional toe clip 304 connecting the sole structure 100 to the upper 200 at the anterior end 12.

With reference to FIGS. 1-3, the brace 302 includes a stanchion 306 formed at a first end and a heel clip 308 formed at a second end. Generally, the stanchion 306 is attached to and extends upwardly from the bolster 112 at the posterior end 14 of the sole structure 100. The stanchion 306 may be described as including a base portion 310 attached to the bolster 112 and a neck portion 312 extending upwardly from the base portion 310 to a distal end 314 adjacent to the heel panel 212 of the upper 200. However, because the bolster 112 projects beyond the heel panel 212 at the posterior end 14 of the article of footwear 10, the neck portion 312 spans a gap between the bolster 112 and the heel panel 212 at the posterior end 14.

With continued reference to FIGS. 1-3, the heel clip 308 is connected to the stanchion 306 at the distal end 314 of the neck portion 312, and is attached to the heel panel 212 of the upper 200. Accordingly, the neck portion 312 extends between and connects the base portion 310 attached to the bolster 112 and the heel clip 308 attached to the heel panel 212. The heel clip 308 is arcuate and extends around the heel panel 212 from a first end 316*a* adjacent to the heel side panel 210 on the lateral side 16 to a second end 316*b* adjacent to the heel side panel 210 on the medial side 18.

Optionally, the support system 300 may include a heel counter 318 disposed between the heel clip 308 and the heel panel 212 of the upper 200. As shown in FIGS. 1-3, the heel counter 318 is spaced apart from the sole structure 100 at the posterior end 14. Accordingly, the heel counter 318 is not directly connected to the sole structure 100, but is instead only indirectly connected to the bolster 112 of the sole structure 100 via the neck portion 312 of the stanchion 306. The heel counter 318 is formed of a resilient polymeric material, and may provide additional cushioning and support around the upper 200 at the posterior end 14.

Referring to FIGS. 1-3, the tensioning system 400 includes the tensioning device 402 disposed within the capsule 404 in the sole structure 100. The tensioning system 400 further includes a cable 406 and a plurality of cable guides 408 configured to route the cable 406 through the sole structure 100 and along the upper 200. Here, the tensioning system 400 includes one or more cable guides 408 attached to the upper 200 for routing the cable 406 and distributing a tension of the cable 406 along the upper 200.

The cable 406 may be highly lubricous and/or may be formed from one or more fibers having a low modulus of elasticity and a high tensile strength. For instance, the fibers may include high modulus polyethylene fibers having a high strength-to-weight ratio and a low elasticity. Additionally or alternatively, the cable 406 may be formed from a molded monofilament polymer and/or a woven steel with or without other lubrication coating. In some examples, the cable 406 includes multiple strands of material woven together.

In some examples, the tensioning system 400 may include one or more cable guides 408. The cable guides 408 may be formed of a rigid, low-friction material (e.g., high density polyethylene, etc.) and have an arcuate inner surface for receiving the tensioning element 410. In some examples, the inner (i.e., cable-contacting) surfaces of the cable guides 408 are lined or coated with a low friction material, such as a lubricous polymer (e.g., polytetrafluoroethylene, etc.), that facilitates movement of the cable 406 therein. By coating the cable guides 408 with a low friction material, the number of turns taken by each lacing pattern can be increased without incurring a detrimentally high (e.g., function impairing) level of friction throughout the cable path.

With reference to FIGS. 1-4, the cable 406 includes a tensioning element 410 that cooperates with the cable guides 408 and the tensioning device 402 to move the article of footwear 10 between the tightened state and the relaxed state. The tensioning element 410 is movable in a tightening direction $D_T$ to move the article of footwear 10 into the tightened state, and in a loosening direction $D_L$ to allow the article of footwear 10 to transition to a relaxed state. In the illustrated example, the tightening force $F_T$ may be applied to the tensioning element 410 by a powered tensioning device 402 disposed in the sole structure.

As best shown in FIGS. 1-4, the tensioning element 410 may be described as including a lateral tensioning strand 412 and a medial tensioning strand 414, which extend along opposite sides of the upper 200 and are connected to each other within the tensioning device 402.

With reference to FIG. 1, the lateral tensioning strand 412 of the tensioning element 410 includes a first end 416 attached at the bite line 28 on the lateral side 16 and is routed along the quarter panel 206 on the lateral side 16 of the upper 200. Referring to FIG. 2, the medial tensioning strand 414 of the tensioning element 410 includes a second end 418 attached at the bite line 28 on the medial side 18 and is routed along the quarter panel 206 on the medial side 18 of the upper 200. Each of the tensioning strands 412, 414 is routed from its respective side of the upper 200 to the tensioning device 402 between the sole structure 100 and a strobel of the upper 200, and connects to the other of the tensioning strands 412, 414 within the tensioning device 402.

As shown in FIG. 1, on the lateral side 16 of the article of footwear 10, the lateral tensioning strand 412 includes a first end 416 of the tensioning element 410 attached at the bite line 28 of the article of footwear 10 at a point adjacent to the forefoot region 20. From the first end 416, the lateral tensioning strand 412 is alternatingly routed between the bite line 28 and the throat 208 along a series of the cable guides 408 arranged along the lateral side quarter panel 206. The lateral tensioning strand 412 is then routed from one of the cable guides 408 adjacent to the bite line 28 in the heel region 24 to the tensioning device 402. The portion of the lateral tensioning strand 412 extending from the lateral side 16 of the upper 200 to the tensioning device 402 is routed between the top side 138 of the cushioning element 114 and a strobel of the upper 200.

As shown in FIG. 2, on the medial side 18 of the article of footwear 10, the medial tensioning strand 414 includes a second end 418 of the tensioning element 410 attached at the bite line 28 of the article of footwear 10 at a point adjacent to the forefoot region 20. From the second end 418, the medial tensioning strand 414 is alternatingly routed between the bite line 28 and the throat 208 along a series of the cable guides 408 arranged along the medial side quarter panel 206. The medial tensioning strand 414 is then routed from one of the cable guides 408 adjacent to the bite line 28 in the heel region 24 to the tensioning device 402. The portion of the medial tensioning strand 414 extending from the medial side 18 of the upper 200 to the tensioning device 402 is routed between the top side 138 of the cushioning element 114 and a strobel of the upper 200.

In the illustrated example, the tensioning device 402 is a powered tensioning device, whereby the tensioning element 410 is moved in the loosening direction $D_L$ and the tightening direction $D_T$ by extending and retracting the tensioning element 410 from the tensioning device 402. Accordingly, the tensioning device 402 may include a powered spool (not shown) for simultaneously winding and unwinding each of the lateral tensioning strand 412 and the medial tensioning strand 414. As shown in FIG. 6, the tensioning device 402 may include actuators 420 for powering the spool in a tightening direction and a loosening direction. The actuators 420 are configured as buttons 420 on the lateral side of the tensioning device 402. The buttons 420 extend through respective openings in the capsule 404 and are exposed through the aperture 146 in the lateral side of the cushioning element 114.

As the tensioning element 410 is wound within the tensioning device 402, an effective length of the tensioning strands 412, 414 (i.e. a length of the strands 412, 414 from the tensioning device to each end 416, 418) is reduced, which causes the cable guides 408 disposed adjacent to the bite line 28 to be drawn towards the cable guides 408 disposed adjacent to the throat 208 on each side of the upper 200. Conversely, when the tensioning element 410 is unwound from the tensioning device 402, an effective length of the tensioning strands 412, 414 increases, which allows the tensioning strands 412, 414 to relax along the sides of the upper 200 so that the cable guides 408 adjacent to the throat 208 can move away from the cable guides 408 adjacent to the bite line 28.

The following Clauses provide exemplary configurations for an article of footwear, a bladder for an article of footwear, or a sole structure for an article of footwear described above.

Clause 1: An article of footwear comprising an upper extending from a first end in a forefoot region to a second end in a heel region and a sole structure attached to the upper and including a posterior end extending beyond the second end of the upper, the sole structure including a bladder having a portion disposed between the second end of the upper and the posterior end of the sole structure.

Clause 2: The article of footwear of Clause 1, further comprising a buttress connecting the posterior end of the sole structure to the second end of the upper.

Clause 3: The article of footwear of Clause 2, wherein the buttress includes a stanchion attached to the posterior end of the sole structure and to a heel clip attached to the second end of the upper.

Clause 4: The article of footwear of Clause 3, wherein the stanchion includes a portion that is spaced apart from the second end of the upper.

Clause 5: The article of footwear of Clause 2, further comprising a heel counter attached to the second end of the upper, the buttress being attached to the second end of the upper at the heel counter.

Clause 6: The article of footwear of Clause 5, wherein the buttress includes a heel clip attached to the heel counter, the heel clip being formed of a first material and the heel counter being formed of a second material having a lower hardness than the first material.

Clause 7: The article of footwear of any of the preceding Clauses, wherein the sole structure includes a footbed and a bolster extending from the footbed at the posterior end.

Clause 8: The article of footwear of Clause 7, wherein a portion of the bladder is located within the bolster of the sole structure.

Clause 9: The article of footwear of Clause 8, wherein the sole structure includes a cushioning element including a first material and a cradle including a second material, the bladder being received between the cushioning element and the cradle.

Clause 10: The article of footwear of any of the preceding Clauses, wherein the sole structure includes a tensioning device disposed therein, the tensioning device receiving a tensioning member and operable to move the tensioning member between an extended state and a retracted state to move the upper between a loosened state and a tightened state.

Clause 11: An article of footwear comprising an upper extending from a first end in a forefoot region to a second end in a heel region and a sole structure attached to the upper and including a posterior end extending beyond the second end of the upper, the sole structure including a bladder having a first portion disposed between the first end of the upper and the second end of the upper and a second portion extending beyond the second end of the upper.

Clause 12: The article of footwear of Clause 11, further comprising a buttress connecting the posterior end of the sole structure to the second end of the upper.

Clause 13: The article of footwear of Clause 12, wherein the buttress includes a stanchion attached to the posterior end of the sole structure and to a heel clip attached to the second end of the upper.

Clause 14: The article of footwear of Clause 13, wherein the stanchion includes a portion that is spaced apart from the second end of the upper.

Clause 15: The article of footwear of Clause 12, further comprising a heel counter attached to the second end of the upper, the buttress being attached to the second end of the upper at the heel counter.

Clause 16: The article of footwear of Clause 15, wherein the buttress includes a heel clip attached to the heel counter, the heel clip being formed of a first material and the heel counter being formed of a second material having a lower hardness than the first material.

Clause 17: The article of footwear of any of the preceding Clauses, wherein the sole structure includes a footbed and a bolster extending from the footbed at the posterior end.

Clause 18: The article of footwear of Clause 17, wherein a portion of the bladder is located within the bolster of the sole structure.

Clause 19: The article of footwear of Clause 18, wherein the sole structure includes a cushioning element including a first material and a cradle including a second material, the bladder being received between the cushioning element and the cradle.

Clause 20: The article of footwear of any of the preceding Clauses, wherein the sole structure includes a tensioning device disposed therein, the tensioning device receiving a tensioning member and operable to move the tensioning member between an extended state and a retracted state to move the upper between a loosened state and a tightened state.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. An article of footwear comprising:

an upper extending from a first end in a forefoot region to a second end in a heel region;

a sole structure attached to the upper and including a posterior end projecting beyond the second end of the upper to form a gap between the posterior end of the sole structure and the upper, the sole structure including a bladder having a portion disposed between the second end of the upper and the posterior end of the sole structure;

a buttress including a base attached to the posterior end of the sole structure, a heel clip attached to the second end of the upper, and a neck portion connecting the base and the heel clip and spanning the gap between the posterior end of the sole structure and the upper; and a heel counter attached to the second end of the upper and disposed between the second end of the upper and the buttress.

2. The article of footwear of claim 1, wherein the buttress is attached to the second end of the upper at the heel counter.

3. The article of footwear of claim 1, wherein the heel clip is formed of a first material and the heel counter is formed of a second material having a lower hardness than the first material.

4. The article of footwear of claim 1, wherein the sole structure includes a footbed and a bolster extending from the footbed at the posterior end.

5. The article of footwear of claim 4, wherein a portion of the bladder is located within the bolster of the sole structure.

6. The article of footwear of claim 5, wherein the sole structure includes a cushioning element including a first material and a cradle including a second material, the bladder being received between the cushioning element and the cradle.

7. The article of footwear of claim 1, wherein the sole structure includes a tensioning device disposed therein, the tensioning device receiving a tensioning member and operable to move the tensioning member between an extended state and a retracted state to move the upper between a loosened state and a tightened state.

8. An article of footwear comprising:

an upper extending from a first end in a forefoot region to a second end in a heel region;

a sole structure attached to the upper and including a posterior end projecting beyond the second end of the upper to form a gap between the posterior end of the sole structure and the upper, the sole structure including a bladder having a first portion disposed between the first end of the upper and the second end of the upper and a second portion extending beyond the second end of the upper;

a buttress including a base attached to the posterior end of the sole structure, a heel clip attached to the second end of the upper, and a neck portion connecting the base and the heel clip and spanning the gap between the posterior end of the sole structure and the upper; and a heel counter attached to the second end of the upper and disposed between the second end of the upper and the buttress.

9. The article of footwear of claim 8, wherein the buttress is attached to the second end of the upper at the heel counter.

10. The article of footwear of claim 8, wherein the heel clip is formed of a first material and the heel counter is formed of a second material having a lower hardness than the first material.

11. The article of footwear of claim 8, wherein the sole structure includes a footbed and a bolster extending from the footbed at the posterior end.

12. The article of footwear of claim 11, wherein a portion of the bladder is located within the bolster of the sole structure.

13. The article of footwear of claim 12, wherein the sole structure includes a cushioning element including a first material and a cradle including a second material, the bladder being received between the cushioning element and the cradle.

14. The article of footwear of claim 8, wherein the sole structure includes a tensioning device disposed therein, the tensioning device receiving a tensioning member and operable to move the tensioning member between an extended state and a retracted state to move the upper between a loosened state and a tightened state.

* * * * *